US007891802B2

(12) United States Patent
Gouch

(10) Patent No.: US 7,891,802 B2
(45) Date of Patent: Feb. 22, 2011

(54) INK PINNING ASSEMBLY

(75) Inventor: Martin Philip Gouch, Herts (GB)

(73) Assignee: FFEI Ltd., Herts (GB)

( * ) Notice: Subject to any disclaimer, the term of this patent is extended or adjusted under 35 U.S.C. 154(b) by 642 days.

(21) Appl. No.: 11/937,683

(22) Filed: Nov. 9, 2007

(65) Prior Publication Data

US 2008/0111874 A1 May 15, 2008

(30) Foreign Application Priority Data

Nov. 15, 2006 (GB) ..... 0622821.7
May 14, 2007 (GB) ..... 0709241.4

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS 4,309,616 A * 1/1982 Wolff ..... 250/494.1
2002/0101157 A1* 8/2002 Suehiro ..... 313/512
2005/0068396 A1 3/2005 Ferran et al.
2005/0195265 A1* 9/2005 Woudenberg ..... 347/105
2006/0023045 A1* 2/2006 Yokoyama et al. ..... 347/102
2006/0197031 A1* 9/2006 de Gheldere et al. ..... 250/432 R

FOREIGN PATENT DOCUMENTS

EP 1579995 A 9/2005
EP 1579995 A1 9/2005
JP 6427639 A 1/1989
JP 64027639 A 1/1989
JP 2277057 A 11/1990

OTHER PUBLICATIONS

Patent Abstracts of Japan, Publication No. 64-27639, Jan. 30, 1989.
Patent Abstracts of Japan, Publication No. 2-277057, Nov. 13, 1990.

* cited by examiner

*Primary Examiner*—Stephen D Meier
*Assistant Examiner*—Alexander C Witkowski
(74) *Attorney, Agent, or Firm*—Kenyon & Kenyon LLP

(57) ABSTRACT

An ink pinning assembly comprises a source of UV radiation suitable for pinning ink on a record medium. A radiation guide device has an inlet facing the source and an outlet through which radiation is emitted towards a record medium, in use, the length of the inlet being greater that the length of the radiation source. The radiation guide device has a substantially rectangular or square wall in plan surrounding a cavity extending between the inlet and outlet, the internal surface of the wall being reflective to the pinning radiation so that pinning radiation with a substantial uniform intensity is emitted from the outlet.

17 Claims, 9 Drawing Sheets

INK PINNING ASSEMBLY

FIELD OF THE INVENTION

This invention relates to ink curing apparatus for use in the curing of inks printed onto a printing medium.

DESCRIPTION OF THE PRIOR ART

A modern monotone printing press typically comprises a printing device, such as an industrial inkjet printer and a curing device. Continuous printing presses often further comprise rollers or conveyor belts to transport a printing medium past a series of printing and curing devices. The printing medium is often a substantially continuous sheet that is transported through the press in order to produce a continuous printed output. In this configuration, a printing device typically extends across the width of the printing medium and is referred to as a "print bar". Once ink has been printed onto the printing medium from a printing device, it first wets, then penetrates, the surface of the printing medium before starting to spread. Often this spreading is undesirable as it can lead to blurring, running or bleeding within a printed representation. Hence, to prevent this undesired spreading, it is standard practice to cure the ink. The curing process involves providing energy to newly deposited ink in order to dry the ink and fix it upon the printing medium. Within a continuous printing press it is vital for the ink to be cured, as, once the ink is applied to a particular section of the printing medium, that section is transported at high speed to other stations for further processing.

The above arrangement can also be extended to utilise a number of different printing devices arranged in series. Such a configuration allows colour printing and is demonstrated in FIG. 1, wherein each printing device or print bar 110 A-D will print an ink of a particular colour. In this configuration, if the ink is only cured after the last print bar 110 D, significant spreading and mixing of a number of different inks on the printing medium 111 can occur before curing. This produces significant print aberrations and so it is common practice to cure the ink immediately after each print bar has deposited ink onto the printing medium. This can be achieved with a number of curing devices 120 A-D positioned after the respective print bars 110 A-D, as shown in FIG. 2.

To provide the energy to cure the ink, the curing devices 120 typically comprise electromagnetic (E/M) radiation sources. These E/M radiation sources will be positioned so that emitted E/M radiation is received by the surface of the printing medium. Ultraviolet (UV) radiation is commonly used when using conventional inks and substrate such as paper or film as the printing medium. When UV radiation is required, the curing devices 120 or E/M radiation sources can comprise linear Mercury lamps with an elliptical cross-section cylindrical reflector to distribute UV radiation over the surface of the paper. In use, the UV radiation sources also emit other wavelength bands such as infra red (IR) radiation and visible light.

When using a colour continuous printing press with paper as the printing medium 111 (as demonstrated in FIG. 2), the power levels of the E/M radiation used for the curing process need to be very carefully controlled. If full curing of the ink deposited by the first print bar 120A occurs before the next print bar 120B deposits additional ink, the previously cured ink prevents the additional ink from wetting the required printing area. Consequentially, this causes errors in the required printing density and generates sub-standard printed images. The problems are also cumulative as the printing medium 111 passes by each print bar in turn. In order to prevent this problem, partial curing of the first ink must be performed to such an extent so that the spread of the ink across the paper 11 is halted but the ink still remains wet. This partial curing process is known in the art as "pin curing" or "pinning" and requires carefully controlled E/M radiation power distribution across the surface of the paper or printing medium 111.

During the pin curing, it is also desirable not to dry the printing medium 111 too much as this will cause shrinkage of the printing medium 111, leading to registration errors between the colours. However, during normal operation, the E/M radiation still needs to be emitted at a significant level to achieve penetration of the printing medium 111 and thus drying of the ink therein. The exact level of E/M radiation required can often change from print job to print job and depends on several factors including the material composition of the printing medium 111, the operating speed of the printing press and the chemical composition of the printed inks themselves.

For pin curing operations using conventional inks printed on paper, it is normal to require only 10% of the power produced by each curing device 120, meaning the curing devices need to be run at 10% of their rated power. Mercury lamps typically have input powers of 120 W/cm (watts per centimetre) that produce 24 W/cm of UV radiation power and so the lamps must be controlled to reduce this amount of UV radiation power. One problem with running these lamps at less than full power is that this affects the stability of the lamp and also changes the spectral output. It also further renders the lamp more prone to ambient temperature changes. Another problem is that electrical control circuitry is required to run the lamps at less than their rated power.

Additionally, if the movement of the printing medium 111 relative to the curing devices 120 were to stop, perhaps due to a mechanical fault, the printing medium would continue to absorb a large amount of E/M radiation. In extreme cases, the printing medium 111 is at risk from catching alight, contributing to a significant health and safety risk. Methods to prevent the transmission of E/M radiation have been proposed involving shutter mechanisms or filters that cover the lamp when the press is stationary. As these shutters or filters need to cover the whole length of the lamp they generally increase the size of the lamp housing, making it difficult to fit the housing between the print bars and increasing the size of the press.

An example of a system for drying ink in a printer is described in US-A-2005/0068396. In this case, the system is designed to irradiate the substrate with far IR so as to dry the ink. The intensity of the IR is varied upon the amount of ink to be printed but it is not concerned with curing.

Thus it is desired to provide an ink curing apparatus that allows efficient operation and reduced running costs, whilst concurrently providing suitable pin curing of deposited inks, without significantly altering the configuration of a standard printing press.

SUMMARY OF THE INVENTION

In accordance with the present invention, an ink pinning assembly comprises a source of radiation suitable for pinning ink on a record medium; and a radiation guide device having an inlet facing the source and an outlet through which radiation is emitted towards a record medium, in use, the length of the inlet being greater that the length of the radiation source, the radiation guide device having a substantially rectangular or square wall in plan surrounding a cavity extending between the inlet and outlet, the internal surface of the wall being reflective to the pinning radiation so that pinning radiation with a substantially uniform intensity is emitted from the outlet.

We have developed a new and simple radiation guide device which enables a relatively small radiation source to be used, and hence at full power, while at the same time enabling radiation to be emitted from the device in a uniform manner and with uniform intensity. In other words, the assembly creates a uniform illumination from a source that is shorter than the length of the inlet and of the region to be uniformly radiated and has a lower intensity than a full length source would give. In this way, the heat (i.e. IR) radiated onto the substrate is minimised rather than maximised it as in the case of US-A-2005/0068396.

In principle, those parts of the wall facing towards each end of the radiation source produce multiple images of the source, each image then combines with the adjacent image so as to produce a near uniform distribution of radiation intensity.

The invention is particularly suited for use with a source generating UV radiation.

The outlet should have preferably a square or rectangular form in plan while the wall preferably comprises four planar sections, opposite sections being parallel. However, the wall sections could also be curved in the direction between the inlet and the outlet.

In a typical embodiment, the number of reflections within the radiation guide device is no more than six or seven while some rays can travel directly to the substrate without reflection. Losses due to reflection are thus much smaller than with a conventional light pipe. This enables the more efficient use of the radiation emitted and minimises the IR radiation produced.

BRIEF DESCRIPTION OF THE DRAWINGS

Some examples of ink pinning assemblies according to the invention will now be described and contrasted with known examples with reference to the accompanying drawings, in which.

DETAILED DESCRIPTION OF THE EMBODIMENTS

Figure 1:
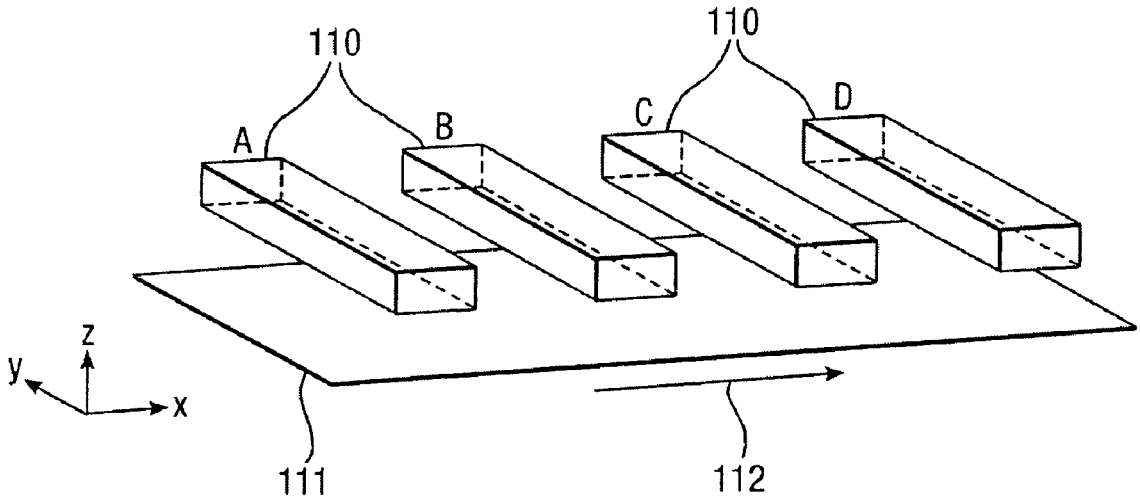
FIG. 1 illustrates a number of different printing devices arranged in series.
Figure 2:
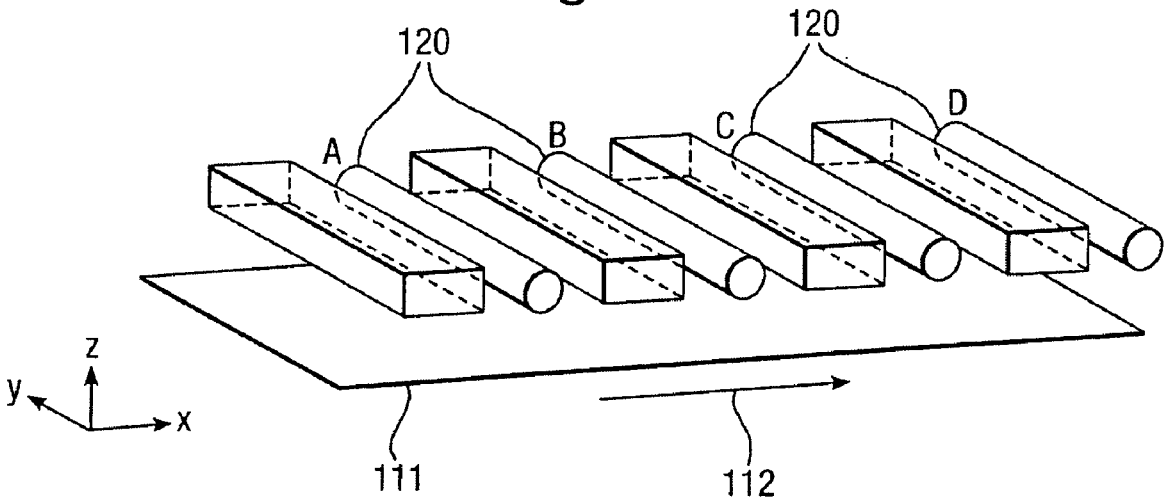
FIG. 2 illustrates the device of FIG. 1 but with the addition of a number of curing devices.
Figure 3:
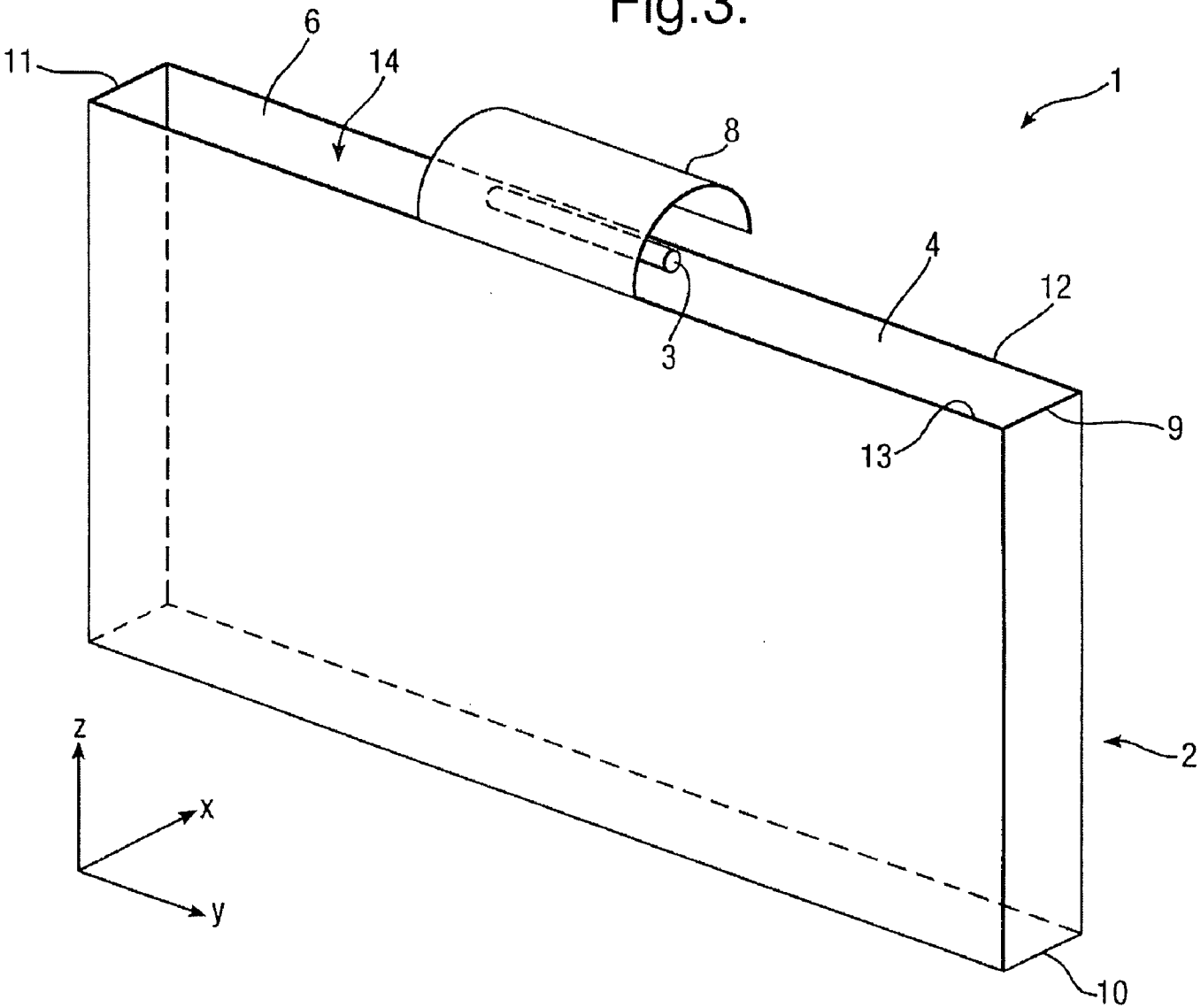
FIG. 3 illustrates an embodiment of a radiation guide device according to the invention.

One arrangement is shown in FIG. 3. Ink curing apparatus 1 comprises an E/M radiation source 3 and an elongate E/M radiation distribution device 2. The E/M radiation source 3 is typically provided by a doped Mercury lamp such as an Iron doped lamp generating UV radiation. The elongate E/M radiation distribution device 2 is in the form of a rectangular box 4 whose sides are defined by four simple, plane reflecting mirrors surrounding a cavity 14. These mirrors include two end surfaces 9, 11, and two side surfaces 12, 13, and an optional lower transparent surface 10 defining an outlet. Alternatively, the outlet could simply be left open. One end 6 of the rectangular box is left open to define an inlet that receives E/M radiation emitted from the E/M radiation source 3. Typical dimensions are 80 mm (length)×10 mm (diameter) for the source and 430 mm (length)×300 mm (height)×40 mm (width) for the box. It will be seen, therefore, that the length of the source 3 is considerably less than that of the device 2. Typically, the source length is less than 50% of the device length and preferably less than 20%.

In this and the other embodiments to be described, the surfaces 9, 11-13 are planar. It is also possible for the surfaces to be curved between the inlet and outlet with the curvatures of opposed surfaces being complementary.

An optional reflector 8 is located behind the E/M radiation source 3 to direct the E/M radiation into the rectangular box 4. The reflector 8 comprises a concave reflecting surface that concentrates a wider distributed amount of E/M radiation into the transmission means 4. The reflector 8 can also have a wavelength dependant reflecting coating that reflects the UV radiation and transmits the IR radiation. This reduces the amount of IR radiation being directed at the printing surface which helps to keep the printing surface cool.

The rectangular box 4 will then direct the UV radiation towards the printing surface and produce a uniform irradiation of the printing surface after passing through the optional transparent window 10.

Hence, the predetermined power distribution required for the process of pin curing can be provided without the use of conventional large and inefficient curing devices. Such an apparatus requires a smaller E/M radiation source. As the source is smaller it emits less E/M radiation whilst operating at full efficiency which makes it easier to control. Thus, the box acts as a mirror box. Sides 12 and 13 concentrate the light towards the substrate in a limited area defined as the exit window 10 by reflecting the UV radiation down the sides 12,13 until it exits the box.

Sides 9 and 10 have a similar function but these sides main task is to even up the illumination along the y axis. In this they can also be viewed as producing multiple images of the lamp along the y axis. Each image then combines with the adjacent image, or original image point, to produce a near uniform distribution in the y axis. Without something attempting to produce a secondary image the single lamp would produce an inverse squared law reduction in intensity the further the substrate is from the lamp.

The fact that the lamp power from an 80 mm length lamp is spread over 430 mm gives a 5.375 factor reduction in radiation on the substrate even if the radiation was entirely uniformly distributed. This reduces the heating of the substrate by this amount. It is normal that mirror coatings do not reflect the long wavelength IR very well so considerable losses in concentrating power occur on the long wavelength IR radiation thus reducing the heating effect further. Typical mirror coatings are reasonably good, (<82%) at reflecting near IR and unless a specialised coating is used the mirrors themselves do not reduce the heating of the substrate. It is the fact that a much shorter lamp can be used which reduces the heating.

In prior art solutions utilising the Mercury lamps described above, complex electrical control systems are required to turn off the lamps when sensors detect the press is stationary to prevent the printing surface catching fire or melting. Turning off the lamp 8 reduces the overall lifetime of each lamp 8 and also a period of time is required for the lamp 8 to cool down and enable the starter mechanism to restart the lamp 8. With the use of the rectangular box 4 the lamp 8 is positioned at some distance from the printing surface, typically over 280 mm. This reduces the amount of heat conducted from the lamp 8 to the printing surface and enables the lamp 8 to be left on whilst the printing surface is stationary without risk of fire or melting of the printing surface.

Pinning requires a careful balance between curing the ink and not curing the ink. Ideally the bottom of the ink layer should be cured thus preventing the ink from spreading and adhering the ink onto the printing surface whilst the upper levels should remain wet enabling subsequent ink layers to wet the surface of the ink and spread rather than ball up which causes poor adhesion and a rough ink surface. Long wavelength UV radiation (UV-A and UV-V) penetrates the ink and can be used to cure the bottom of the ink layer. Short wavelength UV radiation (UV-C) only is nearly completely absorbed at the surface of the ink and cures only the surface of the ink. Mid wavelength UV radiation (UV-B) is a balance between the penetrating UV-A and the surface absorbed UV-C. The curing at the surface is also balanced by oxygen from the atmosphere penetrating the surface of the ink. This oxygen acts as a chemical inhibitor of the curing process. If then there is too much UV-C and UV-B radiation the oxygen inhibition is overcome and full curing takes place. If however the UV-C radiation is removed and UV-B radiation is reduced it is possible to cure the lower part of the ink layer whilst leaving the top part of the ink layer uncured which is the desired effect for pinning.

TABLE 1

Classification of UV bands

| Band | Wavelength Range (nm) |
|---|---|
| UVA | 320-400 |
| UVB | 290-320 |
| UVC | 100-290 |
| UVV | 400-445 |

A normal HgXe lamp typically has UV wavelengths spread over all of the spectrum from UV-V to UV-C and if unfiltered will cure the whole depth of an ink layer. The use of an Iron doped Mercury lamp will produce more UV-A radiation than an undoped Mercury lamp thus reducing the proportion of radiation which is in the UV-C band. If the mirror coatings of the rectangular box 4 on mirror surfaces 9, 11, 12, 13 are made with industry normal Protected Aluminium front surface coatings, with silicon dioxide ($SiO_2$) protective coating, then these mirrors will have a reflectance that starts to fall across the UV-A region. This fall in reflectivity falls from 90% reflectance at the long wavelength end of the UV-A region to approximately 80% reflectance at the short wavelength end of the UV-A. This fall in reflectivity continues across the UV-B and UV-C region. A reduction of reflectivity of the mirror surfaces of 9, 11, 12, 13 from 90% to 80% can typically reduce the amount of irradiation on the printing surface by 35%. A further reduction to 70% will reduce the irradiation on to the printing surface by 50%. This then alters the relative power of the long wavelength UV-A radiation to be a greater proportion of the UV radiation which is desirable for pinning.

Figure 4:
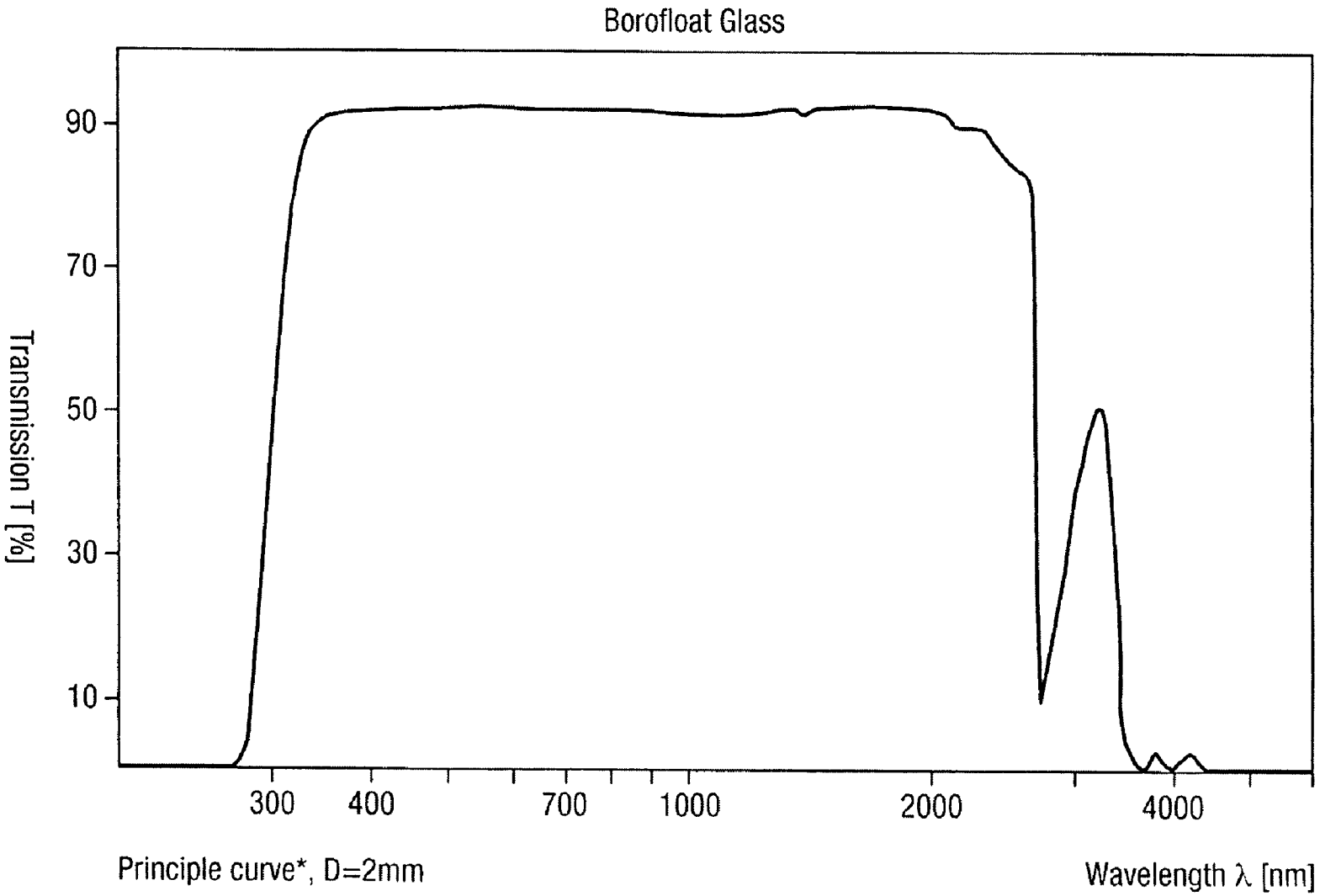
FIG. 4 illustrates the variation of transmission with wavelength of borosilicate glass.

To further reduce the level of UV-C and UV-B radiation without significantly effecting the UV-A and UV-V radiation it is possible to choose the material of window 10 to be Borosilicate Glass. Borosilicate Glass has very little transmission in the UV-C region whilst being highly transmissive in the UV-A region (see FIG. 4). This window 10 can then act as a further UV spectrum filter. It would be possible to use such a window positioned at the entrance aperture 6 of the reflective box 4 but the lamp 8 is in close proximity and is very hot, typically over 600C, and special heat resistant materials would need to be used since the window would need to be cooled. Placing the window 10 at the printing substrate end of the reflecting box has the advantage of reducing the heat significantly, typically to room temperature. It also has the advantage of acting as a barrier to paper dust generated at the substrate which has easy access for cleaning.

The use of an Iron doped bulb 8, the reflective box 4 with normal Protected Aluminium mirror coatings and a window 10 of Borosilicate Glass gives a significantly higher UV-A proportion to the UV radiation over a normal Mercury Bulb. This enables higher levels of radiation for pinning without curing the top surface of the ink. With coloured ink such as process yellow and black ink the colorants in the ink also absorb the UV-A and UV-V radiation which means that unless there are high levels of UV-A radiation the UV-A radiation will not penetrate to the bottom of the layer of ink. If this lack of penetration of the UV-A radiation to the bottom of the ink layer occurs then there will be no or poor adhesion of the ink to the printing surface. This can be compensated for later with a final cure process but this final cure then needs to penetrate multiple layers of ink to ensure good adhesion of the ink to the printing substrate. The higher levels of radiation that the reflective box 4 arrangement enables mean that the UV-A radiation can penetrate to the bottom of the ink layer and give good adhesion to the printing substrate at the pinning stage reducing the need for a very powerful final cure process.

TABLE 2

Proportion of different UV radiation regions

| UV region | Mercury Lamp (%) | Iron doped Lamp with Reflective Box 4 (%) |
|---|---|---|
| UV-V | 25 | 27 |
| UV-A | 38 | 64 |
| UV-B | 34 | 9 |
| UV-C | 3 | 0 |

Figure 5:
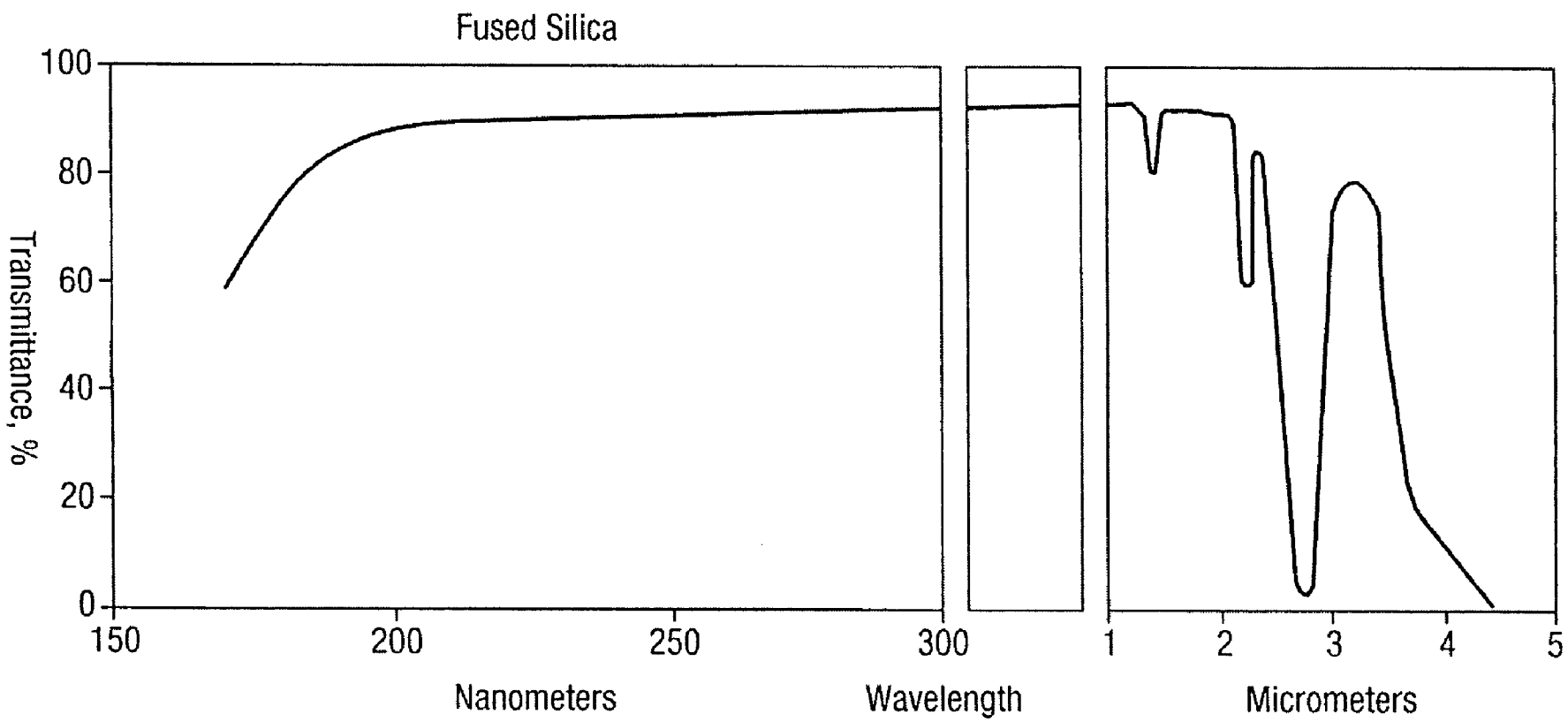
FIG. 5 illustrates the transmission of fused silica at different wavelengths.

If the final printing stage 110D is actually the final printing stage and there are no further printing stages such as an overcoat of varnish then the final pinning box no longer needs to keep the top surface of the ink layer wet. This means we no longer need to reduce the proportion of UV-C radiation. In this final pinning stage it is possible to construct the mirrors of the reflecting box with UV enhanced Aluminium mirrors, MgF protective coating rather than $SiO_2$. These UV enhanced Aluminium mirrors do not drop off reflectivity in the UV-A, UV-B, regions and have much improved reflectivity in the UV-C region. Also if the window 10 is removed or manufactured from UV-B, UV-C transmissive material such as Fused Silica (see FIG. 5) then the levels of UV-B, UV-C radiation will increase whilst still keeping the same levels of UV-A radiation. This will enable not only the lower levels of the ink layer to be cured but the top surface also making the final cure stage easier.

Figure 8:
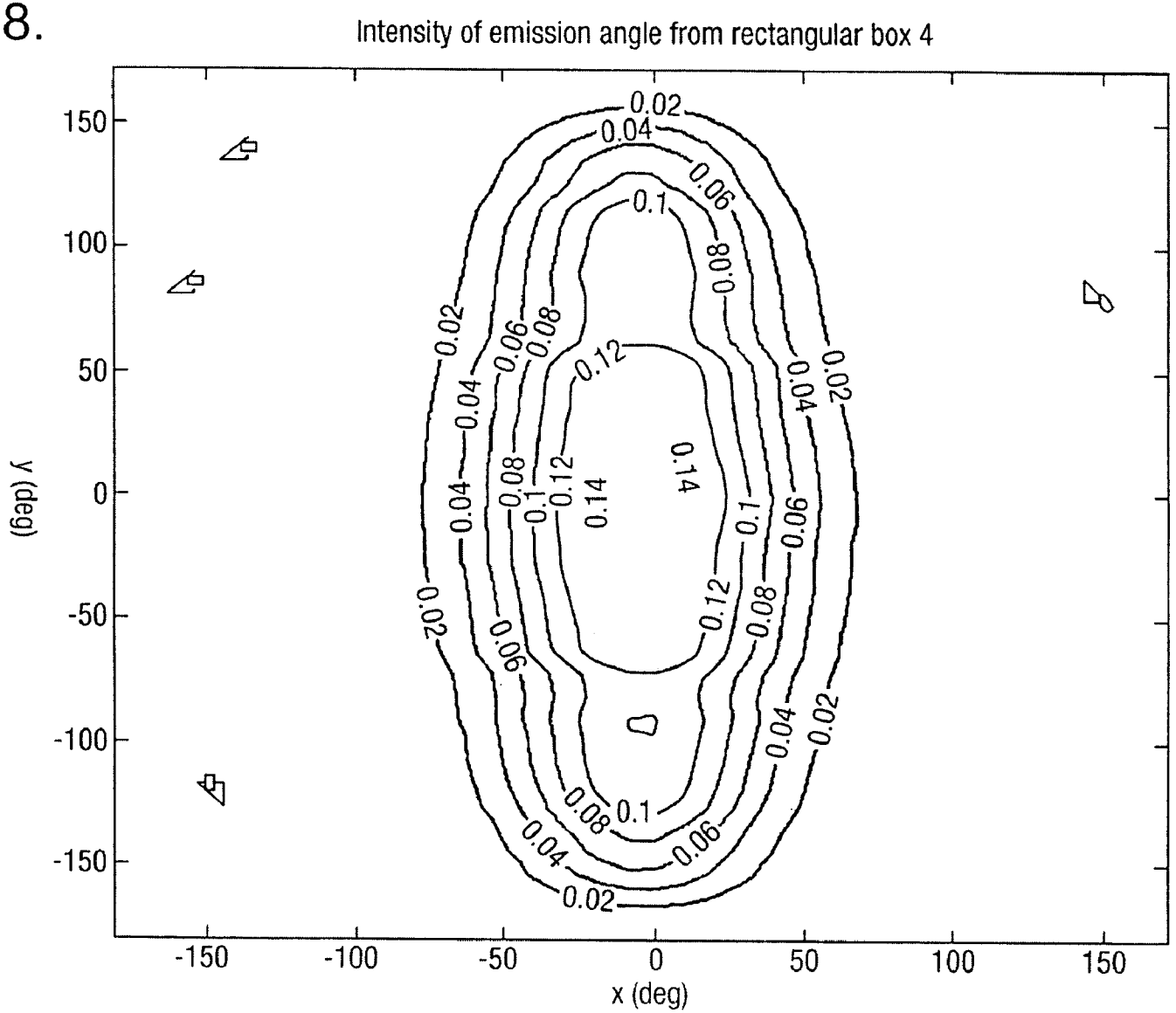
FIG. 8 illustrates the variation of intensity with emission angle from the device shown in FIG. 3.

Another property of the rectangular box 4 is that the angles of emission of the UV radiation are limited in the x direction as is shown by FIG. 8. This then limits the amount of UV radiation which travels towards the substrate directly under the print bar 110. This in turn limits the amount of UV radiation reflected or scattered back up from the printing substrate onto the print bar 110. UV radiation which arrives on the print bar will also the cure the ink in the print bar and block the printing nozzles which is undesirable.

Figure 6:
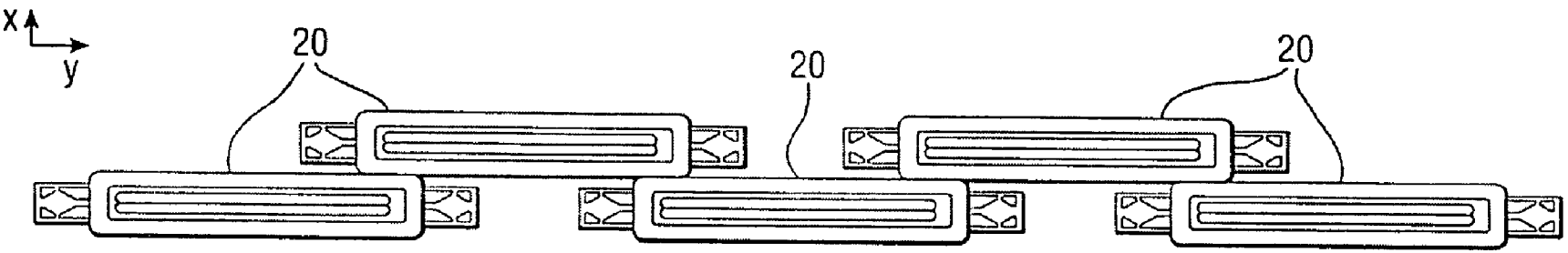
FIG. 6 illustrates a staggered inkjet print bar arrangement.

The time between printing ink dots and the pinning stage permits the dot to spread on the surface of the printing substrate. This time is determined by the time it takes for the printing substrate to traverse from the printing head 110 to the pinning bar 120. If the printing bar 110 is in a straight line or rectilinear then this means the dot growth, and as such the density printed, is effected by the speed of printing but this is uniform across the printing substrate. Unfortunately inkjet print bars are not always in a straight line but are normally built in a staggered arrangement as shown in FIG. 6. It is not economical to build a print head 20 the width of a web, where a print head is a single inkjet printing unit, as each press with a different web width would require a new print head design and economy of scale would not be possible. So to produce a print bar 110 the print heads 20 are assembled in an overlapping arrangement which enables economy of scales of manufacture of the print heads 20 and variable length print bars 110. This staggered arrangement leads to a staggered time across the web between the printing of ink drops and the pinning of the ink drops which means a staggered dot growth across the printing substrate.

Figure 7:
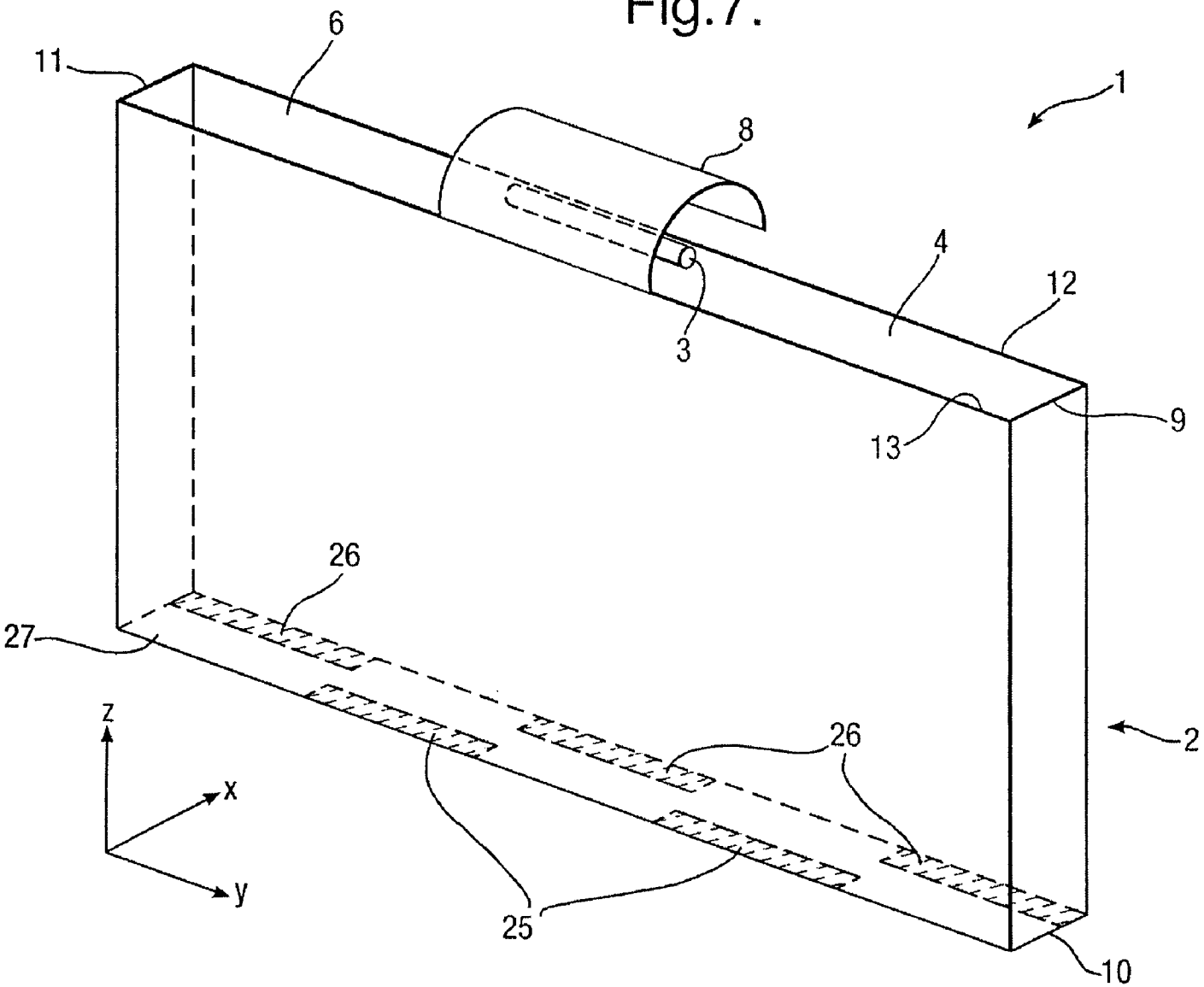
FIG. 7 illustrates a second embodiment of a radiation guide device according to the invention.

A second aspect of the invention is to optionally add a set of obscurations 25 to the exit window 10 to create a staggered aperture (FIG. 7). If the length of the obscurations 25 in the y direction is the same as the separations of the print head 20 in the y direction and the height of the obscurations 25 in the x direction is the same as the separation of the print heads 20 then the time between the printing of the ink dots and the pinning of the print dots becomes uniform and the growth of the dots becomes uniform making a uniform density across the printing substrate. In addition a further set of obscurations 26 are added to the window 10 so that the total exposure to UV light remains constant otherwise the ink passing under the obscurations 25 would receive a lower exposure of UV radiation than the rest of the printing substrate that did not pass under any obscuration. It is not always necessary to fully compensate for the stagger time difference so optionally the time difference can be reduced rather than fully eliminated. This would enable a reduction of the effect of none uniform dot growth across the printing substrate to a point where it was either acceptable or not measurable. This is because the rate of growth of the dot is very none linear and the majority of the dot growth occurs very soon after the ink has touched the printing substrate before the ink passes under the rectangular box 4. Thus the magnitude of the staggered dot growth effect is small in comparison with the total dot growth.

Figure 9:
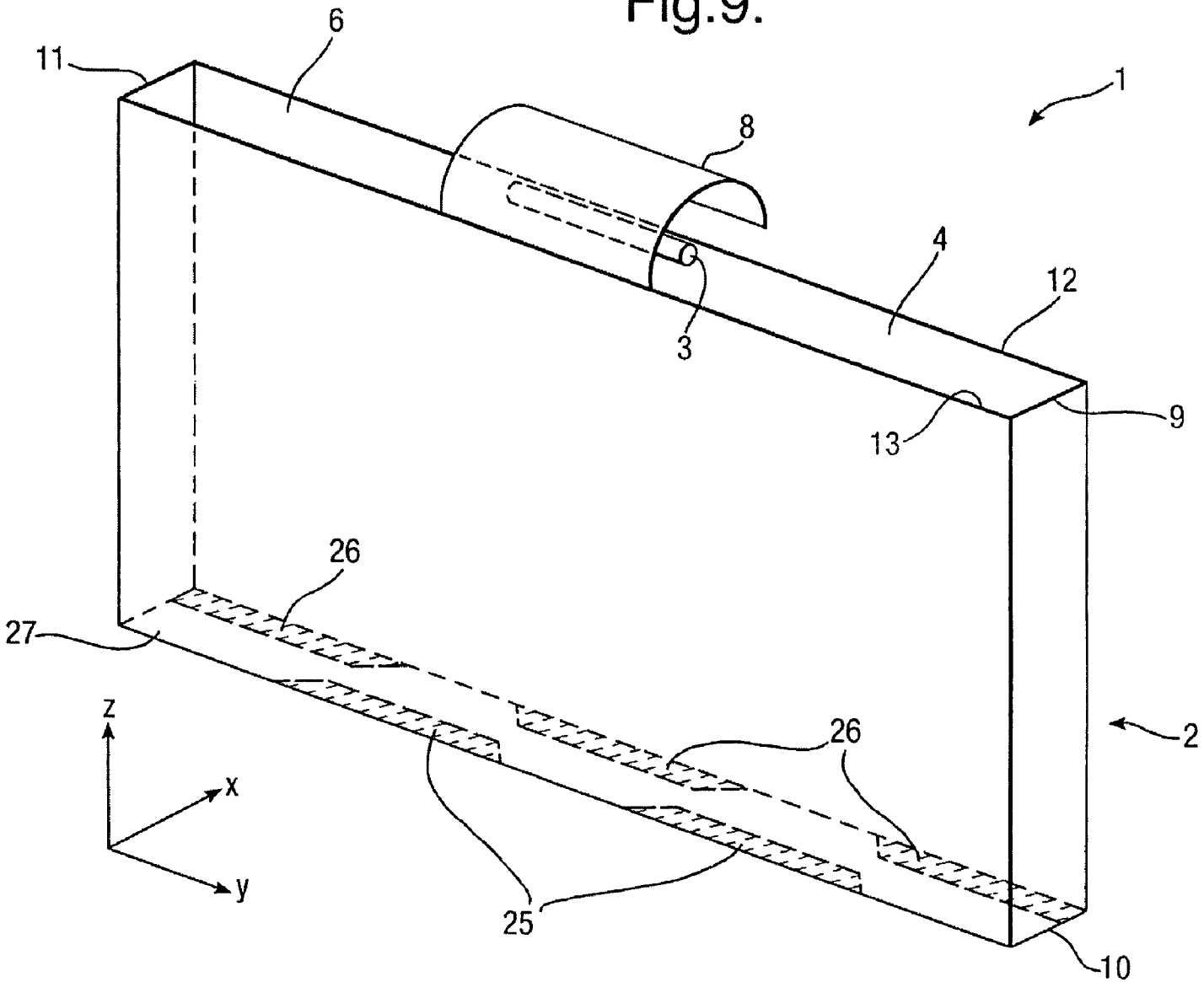
FIG. 9 illustrates a third embodiment of a radiation guide device according to the invention; and, FIG. 10 illustrates a fourth embodiment of a radiation guide device according to the invention.

Optionally the obscurations 25,26 are not rectangular in shape but tapered as shown in FIG. 9 or curved such that the total width of the aperture 27 remains constant. If the obscurations 25,26 were rectangular in shape and the rectangular box 4 was mounted skewed to the direction of movement of substrate then some of the printing substrate in the overlap region would receive an increased radiation and some of the printing substrate in the overlap region would receive decreased radiation. Similarly the same effect would occur if there was web weave whilst the printing substrate was passing under the rectangular aperture 4. If the obscurations have tapered sides this effect is reduced.

In the embodiments shown in the drawings, the degree of uniformity may be acceptable but in some cases the drop off in intensity at the ends of the outlet 10 in the y direction will be unacceptable. It is important, however, that the means adopted to correct for this non-uniformity does not impede the ability of the system to independently control the intensity of the radiation by turning up and down the power to the lamp 3 and to control the dosage of the system by passing a shutter (not shown) across the outlet 10 in the x direction.

One simple way to reduce the dosage of radiation at the centre in the y axis is to put a curved aperture (not shown) at the exit window 10 which restricts the light emitted from the middle of the aperture and does not restrict the radiation from the edge of the aperture. This however does not effect the intensity of the light emitted along the length of the window 10. It is desirable to maintain not only a uniform dosage but a uniform intensity of radiation along the window 10.

A further alternative is to use a graduated transparency window 10 (not shown) such as a thin absorbing or reflecting coating commonly used in partially reflecting mirrors. These mirrors can be expensive to produce over such large areas.

Figure 10:
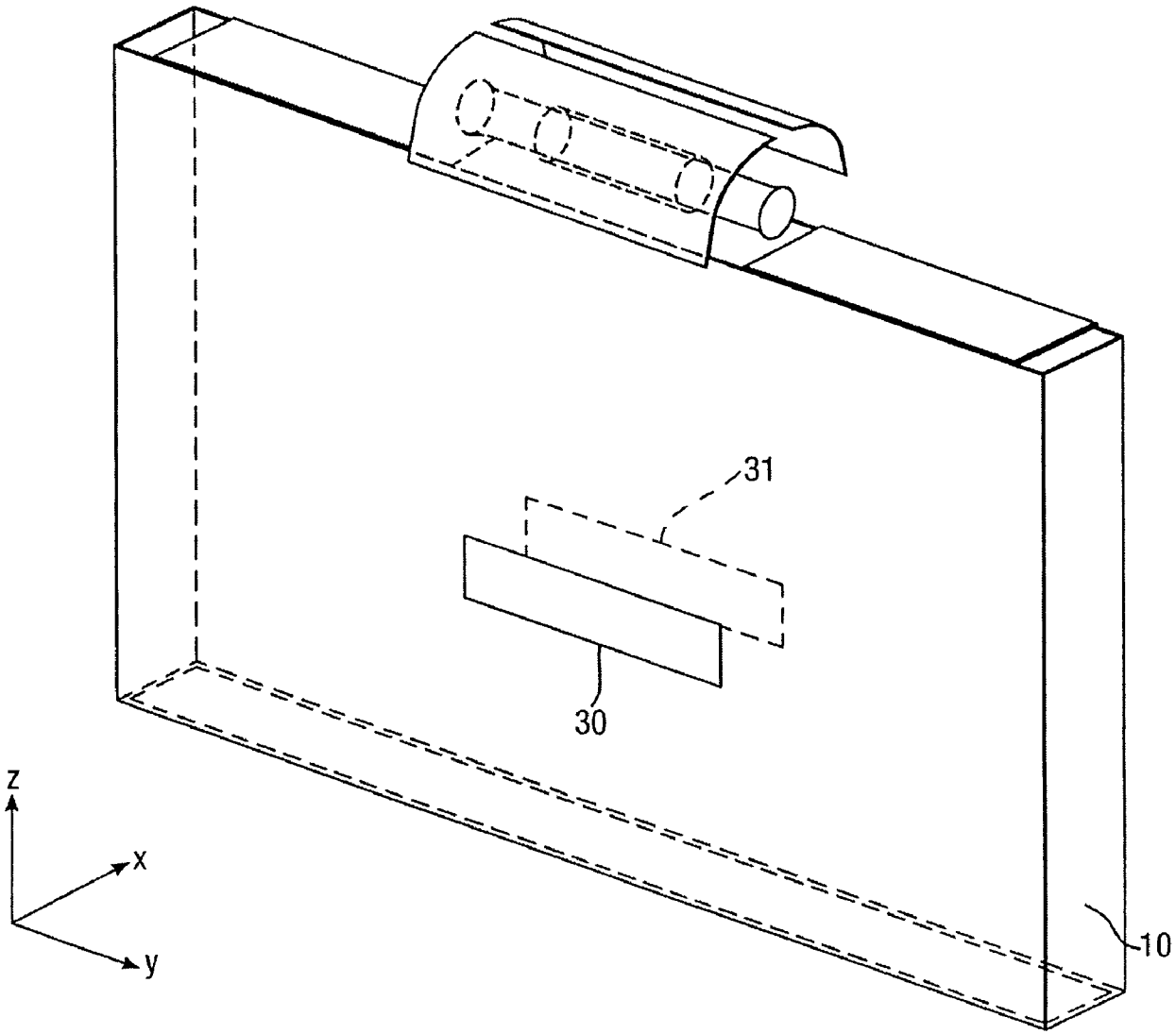

A further and preferred alternative to reduce the intensity at the centre of the exit window is to place a rectangular or other shaped non-reflecting patch 30,31 part of the way up the sides of the large side mirrors of the box 12 and 13 (see FIG. 10). The length (y) of these non-reflecting patches 30,31 in the y axis effects how wide across the exit window 10 this effects and the depth of the patches (z) effects the magnitude of the reduction in intensity. The height of the non-reflecting patches 30,31 above the window 10 affects the sharpness of transition from effect to no effect. Thus it is possible with the use of a rectangular non-reflecting patch to correct for a gentle non-uniformity across the length of the window 10 in the y axis. This is preferable because there are no sudden changes in intensity and the dosage is then maintained along the length (y) of the window 10.

The method of placing the non-reflecting patches 30,31 could be one of but not exclusive to a) not coating the mirror surface at time of coating the side wall 12 and 13.
b) Etching off the non-reflecting patch
c) Scratching off the non-reflecting patch
d) Print on the non-reflecting patch
e) Painting the non-reflecting patch
f) Gluing of a non-reflecting patch.

I claim:

1. An ink pinning assembly comprising a source of radiation suitable for pinning ink on a record medium; and a radiation guide device having an inlet facing the source and an outlet through which radiation is emitted towards a record medium, in use, the length of the inlet being greater than the length of the radiation source, the radiation guide device having a substantially rectangular wall in plan surrounding a cavity extending between the inlet and outlet, parts of the internal surface of the wall being reflective to the pinning radiation while other parts of the wall are non-reflective, the non-reflective parts of the wall being formed by rectangular patches so that pinning radiation with a substantially uniform intensity is emitted from the outlet.

2. An assembly according to claim 1, wherein the source generates UV radiation.

3. An assembly according to claim 2, wherein the source comprises a mercury lamp, preferably an iron doped mercury lamp.

4. An assembly according to claim 1, wherein the wall is adapted to reflect a higher percentage of UV-A radiation entering the inlet than UV-B and UV-C radiation.

5. An assembly according to claim 1, wherein the wall is provided with a $SiO_2$ or MgF coating.

6. An assembly according to claim 1, wherein the internal surface of the wall defines a mirror.

7. An assembly according to claim 1, wherein the wall is made of aluminium.

8. An assembly according to claim 1, wherein the wall comprises four planar sections, opposite sections being parallel.

9. An assembly according to claim 1, wherein the outlet comprises a radiation filter which transmits a higher percentage of the pinning radiation than radiation from the source at other wavelengths.

10. An assembly according to claim 9, wherein the radiation filter comprises a fused silica or borosilicate glass.

11. An assembly according to claim 1, wherein the source is positioned between 100 and 600 mm from the inlet to the radiation guide device.

12. An assembly according to claim 1, further comprising a reflector located behind the source and designed to reflect pinning radiation towards the radiation guide device.

13. An assembly according to claim 1, wherein the outlet defines a staggered profile aperture.

14. An assembly according to claim 1, wherein the rectangular patches have the same shape and are located in alignment on opposite major surfaces of the rectangular device.

15. An assembly according to claim 1, wherein the length of the radiation source is less than 50% of the length of the inlet.

16. An assembly according to claim 15, wherein the length of the radiation source is less than 20% of the length of the inlet.

17. Printing apparatus comprising a sequence of printing devices spaced apart along a process direction, each printing device extending transversely to the process direction; and a corresponding number of ink pinning assemblies, a respective ink pinning assembly being located downstream of each printing device and with its outlet transverse to the process direction, wherein each ink pinning assembly includes a source of radiation suitable for pinning ink on a record medium; and a radiation guide device having an inlet facing the source and an outlet through which radiation is emitted towards a record medium, in use, the length of the inlet being greater that the length of the radiation source, the radiation guide device having a substantially rectangular wall in plan surrounding a cavity extending between the inlet and outlet, parts of the internal surface of the wall being reflective to the pinning radiation while other parts of the wall are non-reflective, the non-reflective parts of the wall being formed by rectangular patches so that pinning radiation with a substantially uniform intensity is emitted from the outlet.

* * * * *